US012048336B2

(12) United States Patent
Akerson

(10) Patent No.: US 12,048,336 B2
(45) Date of Patent: Jul. 30, 2024

(54) MULTI-LAYER NURSING GARMENT

(71) Applicant: Akerson IP LLC, Las Vegas, NV (US)

(72) Inventor: Deeanne Akerson, Oceanside, CA (US)

(73) Assignee: Akerson IP LLC, Las Vegas, NV (US)

( * ) Notice: Subject to any disclaimer, the term of this patent is extended or adjusted under 35 U.S.C. 154(b) by 184 days.

(21) Appl. No.: 17/720,547

(22) Filed: Apr. 14, 2022

(65) Prior Publication Data

US 2023/0329359 A1 Oct. 19, 2023

(51) Int. Cl.
*A41C 3/00* (2006.01)
*A41C 3/04* (2006.01)
*A41D 1/215* (2018.01)

(52) U.S. Cl.
CPC ..... *A41C 3/0028* (2013.01); *A41C 3/0014* (2013.01); *A41C 3/04* (2013.01); *A41D 1/215* (2018.01)

(58) Field of Classification Search
CPC ..... A41C 3/0028; A41C 3/0014; A41C 3/04; A41D 1/215
USPC ..... 450/1
See application file for complete search history.

(56) References Cited

U.S. PATENT DOCUMENTS 2,679,048 A 5/1954 Alberts
2,738,509 A 3/1956 Bauder
4,335,728 A 6/1982 Fildan
4,648,404 A 3/1987 Clark
4,878,879 A * 11/1989 Kunstadter ..... A41C 3/04 223/111
5,380,238 A 1/1995 Crew-Gee
5,485,658 A 1/1996 Fildan
5,624,296 A 4/1997 Weber-Unger
6,074,273 A 6/2000 Turner et al.
6,083,079 A 7/2000 Pearson
6,165,047 A 12/2000 Scott et al.
6,227,936 B1 5/2001 Mendoza
6,319,092 B1 11/2001 Leyhe et al.
6,336,840 B2 1/2002 Heroff
6,364,739 B1 4/2002 Dutka et al.
6,645,041 B2 11/2003 Sorensen
(Continued)

FOREIGN PATENT DOCUMENTS

AU 2013203882 10/2014
EP 2810573 8/2016
(Continued)

OTHER PUBLICATIONS

Belibea bra. Oct. 19, 2016. www.instagram.com/P/BLwbn4UhvsE/.
(Continued)

*Primary Examiner* — Timothy K Trieu
(74) *Attorney, Agent, or Firm* — Jordan IP Law, LLC

(57) ABSTRACT

A multi-layered nursing garment including a shoulder strap, a support strap, an inner breast cup, an outer breast cup, and multiple connectors including: a first connector attached to the outer breast cup; a second connector attached to the shoulder strap; a third connector attached to the inner breast cup; a fourth connector attached to the outer breast cup; and a fifth connector (support strap connector) attached to the support strap. In various modes, opening/lowering of the outer breast cup is achieved concurrently or independently of the inner breast cup and vice versa to selectively facilitate breastfeeding and/or breast pumping (e.g., hands-free breast pumping).

14 Claims, 10 Drawing Sheets

(56) References Cited

U.S. PATENT DOCUMENTS

| | | | | |
|---|---|---|---|---|
| 7,081,034 | B1 | 7/2006 | Zoellner | |
| 7,094,217 | B2 | 8/2006 | Fialkoff | |
| 7,448,936 | B1 | 11/2008 | Kemp-Dorsey | |
| 8,057,452 | B2 | 11/2011 | Fialkoff | |
| 8,192,247 | B2 | 6/2012 | Abbaszadeh | |
| 8,307,463 | B2 | 11/2012 | Ritchie | |
| 8,323,070 | B2 | 12/2012 | Abbaszadeh | |
| 8,469,770 | B2 | 6/2013 | Alva | |
| 8,657,643 | B2 | 2/2014 | Perez | |
| 8,801,495 | B1 | 8/2014 | Guindon | |
| 9,155,339 | B2 | 10/2015 | Alva | |
| 9,167,855 | B2 | 10/2015 | Abbaszadeh | |
| 9,402,425 | B2 | 8/2016 | Cortese et al. | |
| 9,498,005 | B2 | 11/2016 | Abbaszadeh | |
| 9,629,396 | B2 | 4/2017 | Alva | |
| 9,872,524 | B2 | 1/2018 | Abbaszadeh | |
| 9,894,942 | B2 | 2/2018 | Burrell | |
| 10,231,491 | B2 | 3/2019 | Akerson et al. | |
| 10,420,378 | B2 | 9/2019 | Kosak | |
| 10,426,203 | B2 | 10/2019 | Kosak | |
| 10,537,141 | B2 | 1/2020 | Akerson et al. | |
| 2005/0085160 | A1* | 4/2005 | Johnstone | A41C 3/04 450/36 |
| 2008/0003921 | A1 | 1/2008 | Fildan et al. | |
| 2008/0064299 | A1 | 3/2008 | La Fontaine | |
| 2009/0265830 | A1 | 10/2009 | Hendrickson | |
| 2010/0031418 | A1 | 2/2010 | Op't Hof | |
| 2010/0068971 | A1 | 3/2010 | Hendrickson | |
| 2010/0159801 | A1 | 6/2010 | Abbaszadeh | |
| 2010/0159802 | A1 | 6/2010 | Abbaszadeh | |
| 2010/0261410 | A1 | 10/2010 | Hirtz | |
| 2011/0130072 | A1 | 6/2011 | Lander | |
| 2011/0314587 | A1 | 12/2011 | Ritchie | |
| 2012/0184179 | A1 | 7/2012 | Blitz | |
| 2013/0095727 | A1 | 4/2013 | Abbaszadeh | |
| 2014/0087625 | A1 | 3/2014 | Ironi | |
| 2014/0273737 | A1 | 9/2014 | Cortese et al. | |
| 2014/0364035 | A1 | 12/2014 | Abbaszadeh | |
| 2014/0364036 | A1 | 12/2014 | Abbaszadeh | |
| 2016/0015092 | A1 | 1/2016 | Abbaszadeh | |
| 2016/0150834 | A1* | 6/2016 | Boele | A41C 3/04 450/36 |
| 2016/0183602 | A1 | 6/2016 | Rider et al. | |
| 2016/0206007 | A1 | 7/2016 | Op't Hof | |
| 2016/0331045 | A1 | 11/2016 | Cortese et al. | |
| 2017/0273366 | A1 | 9/2017 | Hoth | |
| 2017/0280786 | A1 | 10/2017 | Abbaszadeh | |
| 2018/0000168 | A1 | 1/2018 | Alva | |
| 2018/0064177 | A1 | 3/2018 | Akerson et al. | |
| 2018/0064178 | A1* | 3/2018 | Akerson | A41C 3/02 |
| 2018/0092408 | A1 | 4/2018 | Hensel | |
| 2018/0103691 | A1 | 4/2018 | Alva | |
| 2018/0132542 | A1 | 5/2018 | Abbaszadeh | |
| 2018/0206559 | A1 | 7/2018 | Kosak | |
| 2019/0037931 | A1 | 2/2019 | Akerson et al. | |
| 2019/0142078 | A1 | 5/2019 | Kosak | |
| 2019/0261698 | A1* | 8/2019 | Akerson | A41D 1/002 |

FOREIGN PATENT DOCUMENTS

| | | |
|---|---|---|
| FR | 2761238 | 10/1998 |
| GB | 2536541 | 9/2019 |
| KR | 20110001216 | 2/2011 |

OTHER PUBLICATIONS

Nourish Essentials 3pk, Oct. 4, 2016, www.instagram.com/p/BLJzYWfByje/.

ABCKidsExpo, Oct. 18, 2016, www.instagram.com/p/BLtigR3hRt6/.

* cited by examiner

MULTI-LAYER NURSING GARMENT

TECHNICAL FIELD

This invention generally relates to a nursing garment and, more specifically, to a multi-layered nursing garment for comfortably breastfeeding or pumping or expressing of breast milk.

BACKGROUND OF THE INVENTION

Breastfeeding, including pumping or expressing of breast milk, has important benefits including nutrition and immunity to illnesses for a baby, as well as psychological factors such as mother/baby bonding. Additional benefits of breastfeeding include (for the baby): breastmilk is easier for a baby to digest and is "made to order" (breastmilk composition changes as baby ages and even throughout the day to meet a growing baby's needs), associated with increased IQ, decreased risk of obesity, decreased risk of childhood illness and cancers (asthma, diabetes, heart disease, ear infections), decreased risk of SIDS, and increased bonding between mother and baby.

Risks of not breastfeeding include (for the mother): increased risk of obesity, increased risk of blood pressure instability, return of menstrual cycle possibly leading to closely spaced pregnancy and lack of conservation of nutrients, increased rate of postpartum depression, increased sleep disturbances, increased risk of breast and ovarian cancer, increased risk of cardiovascular disease, increased risk of type 2 diabetes, increased risk of Rheumatoid arthritis, and osteoporosis. Additional negative effects of unsuccessful breastfeeding are working mothers missing more workdays due to increase in baby being sick, increased cost due to purchase of formula, and increase in health expenses due to decreased health.

The above benefits and risks are well documented in scientific theory and literature. Thus, it is highly desirable to provide inventions that make it easier and more comfortable for a woman to nurse (including the pumping or expression of breast milk).

Many nursing garments are known in the prior art. However, opening or closing the breast cups of these nursing garments while managing other factors can be difficult. A nursing woman is physically restricted in her ability to manage these factors while securing and maintaining breast cups in place. A long-felt need has existed for a nursing garment that will allow a woman to both breastfeed and/or pump, either alternately or simultaneously, from different breasts, without the woman having to change her clothes.

SUMMARY OF THE INVENTION

Provided herein is a multi-layered nursing garment. The nursing garment includes, at least in part, an inner breast cup configured to cover a first breast of a wearer, an outer breast cup configured to cover the inner breast cup and a shoulder strap. In various modes, opening/lowering of the outer breast cup is achieved independently of the inner breast cup and vice versa to selectively facilitate breastfeeding and/or breast pumping (e.g., hands-free breast pumping).

The nursing garment includes multiple connectors: the outer breast cup is attached to a first connector, the shoulder strap is attached to a second connector and the inner breast cup is attached to a third connector. The outer breast cup is further attached to a fourth connector and the third connector is configured to couple the fourth connector. In a preferred embodiment, the fourth connector includes a loop and is attached to an interior side of the outer breast cup.

In an embodiment, the first connector is configured to couple to the second connector such that the outer breast cup can be selectively opened or closed relative to the shoulder strap (via decoupling or coupling of the first connector and the second connector).

Preferably, the multi-layered nursing garment further includes a support strap attached to a fifth connector (a support strap connector) and the third connector (attached to the inner breast cup) is configured to be coupled to the fifth connector. As such, the inner breast cup is selectively connectable to the outer breast cup (at the fourth connector) or directly to the support strap (at the fifth connector). In a preferred embodiment, the support strap is connected to the second connector via the fifth connector (to connect the support strap and the shoulder strap) and the fifth connector includes a loop. In some embodiments, the fifth connector includes a second loop or both a second loop and a third loop.

In some embodiments, the inner breast cup includes an opening. Preferably, the opening is configured to receive a portion of a breast pump.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION

The present invention provides a nursing bra or other nursing garment with two breast cups of multilayer fabric, each of which can be opened for breastfeeding or pumping the milk from breasts with ease of opening or closing breast cups separately. The invention further provides various connectors that allow a nursing woman to peel off one or more layers of the nursing garments as per her convenience.

The term "nursing" is defined as breastfeeding, which, in turn, can relate to pumping or expressing of milk. The terms "a" and "an" are defined as one or more unless this disclosure explicitly requires otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. The term "coupled" is defined as connected or attached, although not necessarily directly unless otherwise specified, and not necessarily mechanically. The term "decoupled" is defined as detached or disconnected. The term "connector" refers generally to a device that can used in reversibly coupling two or more objects together by means of a mechanical connection, e.g., a hook, button, loop, clasp, clip, snap or other known means of removable attachment.

The present invention now will be described more fully hereinafter with reference to the accompanying drawings, in which some, but not all, embodiments of the inventions are shown. While the following description details preferred embodiments of the present invention, this patent application is not limited in its application to the details of construction and arrangement of the parts illustrated in the accompanying drawings.

With reference to the figures, numerical designation has been given for each element to facilitate the reader's understanding of the present invention, and particularly with reference to the embodiments of the present invention illustrated in the figures. Various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and configuration of those components described herein and shown in the accompanying figures can be made without changing the overall scope and function of the invention set forth herein.

Figure 1:
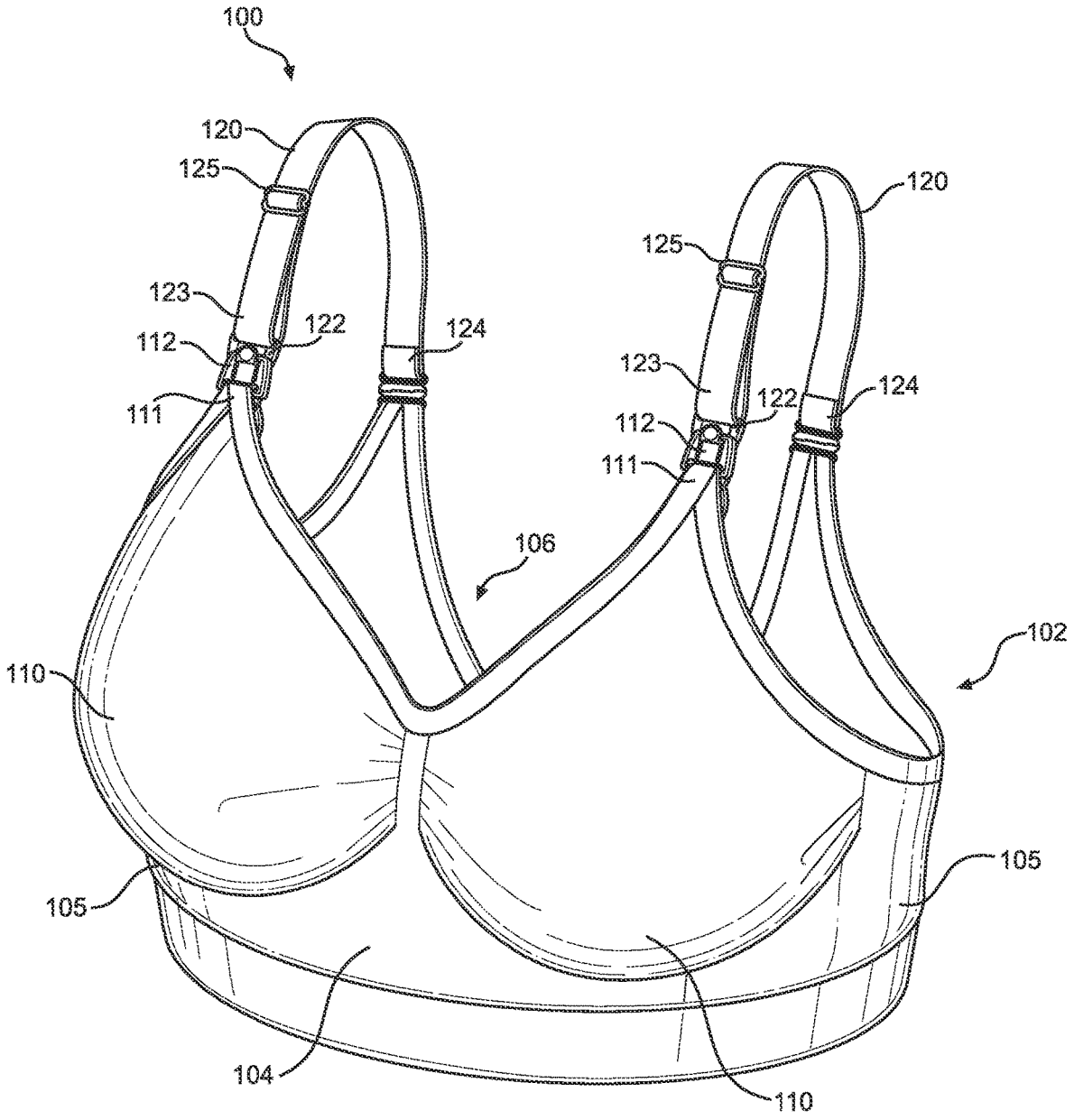
FIG. 1 is a perspective view of a multi-layer nursing garment in accordance with a first mode embodiment of the present invention.
Figure 2:
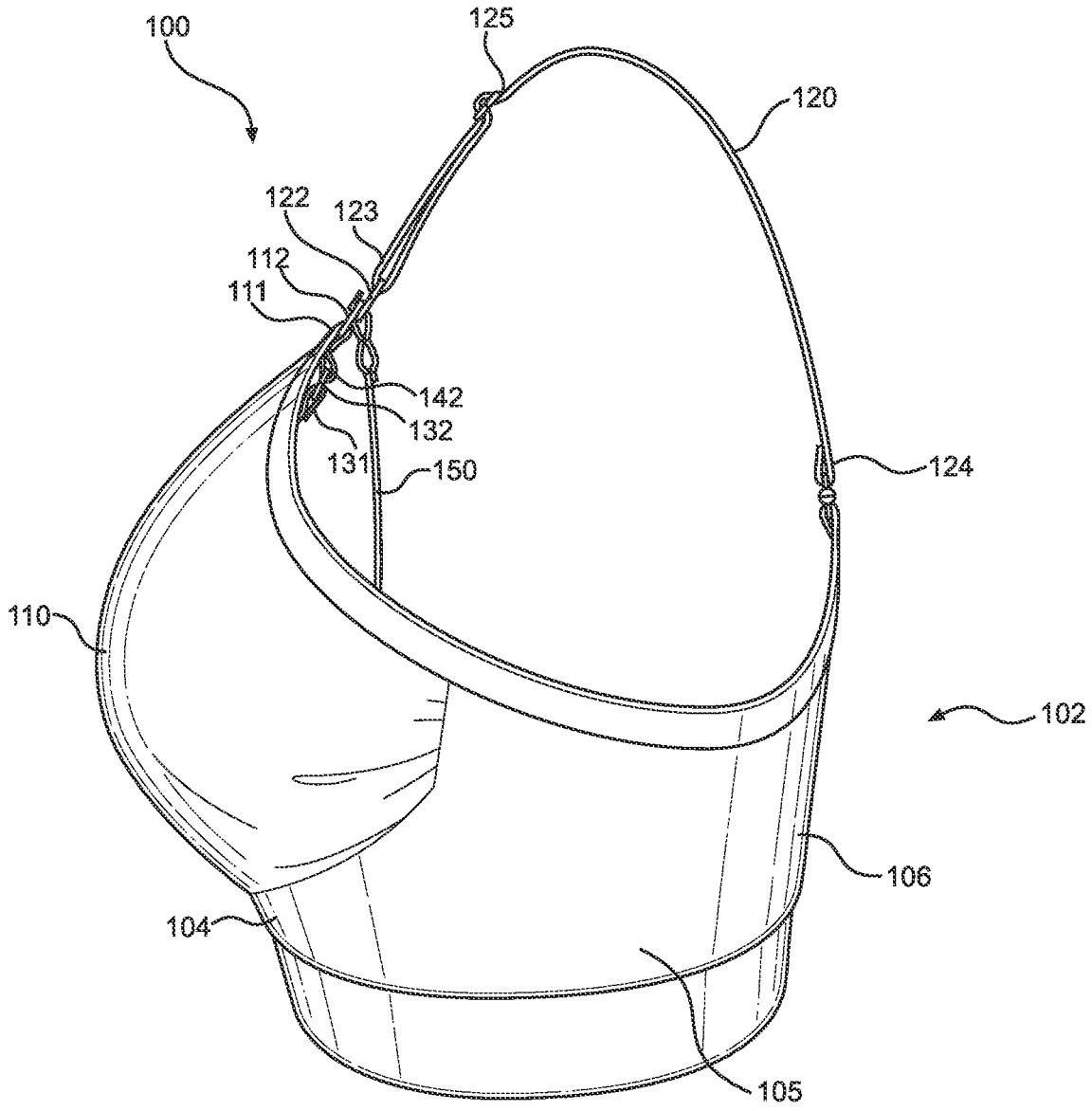
FIG. 2 is a side view of the multi-layer nursing garment in accordance with the first mode embodiment of the present invention.

Referring now to the figures, in an exemplary embodiment of the present invention, a multi-layer nursing garment is described. As shown in FIGS. 1 and 2, a nursing garment 100 is depicted as a brassiere or bra. However, it should be appreciated that nursing garment 100 may be otherwise embodied. For example, in some embodiments, nursing garment 100 may be embodied as a nursing bra but need not be limited to a nursing bra. For instance, nursing garment 100 can take the form of a nursing top, a nursing shirt, nursing tank, nursing camisole, nursing nightgown, nursing dress or other item of women's clothing used for breastfeeding and including the features described herein and/or is otherwise capable of performing the functions described herein. Nursing garment 100 includes a body support 102 having a front portion 104 connected through side portions 105 to a back portion 106. Front portion 104 and side portions 105 connect to a pair of outer breast cups 110. In some embodiments, portions 104-106 and outer breast cups 110 are formed integrally. Top portions 111 of outer breast cups 110 are attached to first connectors 112. A pair of shoulder straps 120 each has a second connector 122 attached to a respective first end 123 thereof. Some connectors used in nursing garment 100, including second connectors 122, are described in further detail below with reference to FIGS. 8-12. As shown in the embodiment of FIGS. 1 and 2, first connectors 112 are configured to couple to respective second connectors 122. Second ends 124 of shoulder straps 120 connect to back portion 106. Adjustment mechanisms 125 are located on straps 120 between first ends 123 and second ends 124 to assist in adjusting the lengths of straps 120 to provide a more comfortable fit for the wearer.

Figure 3:
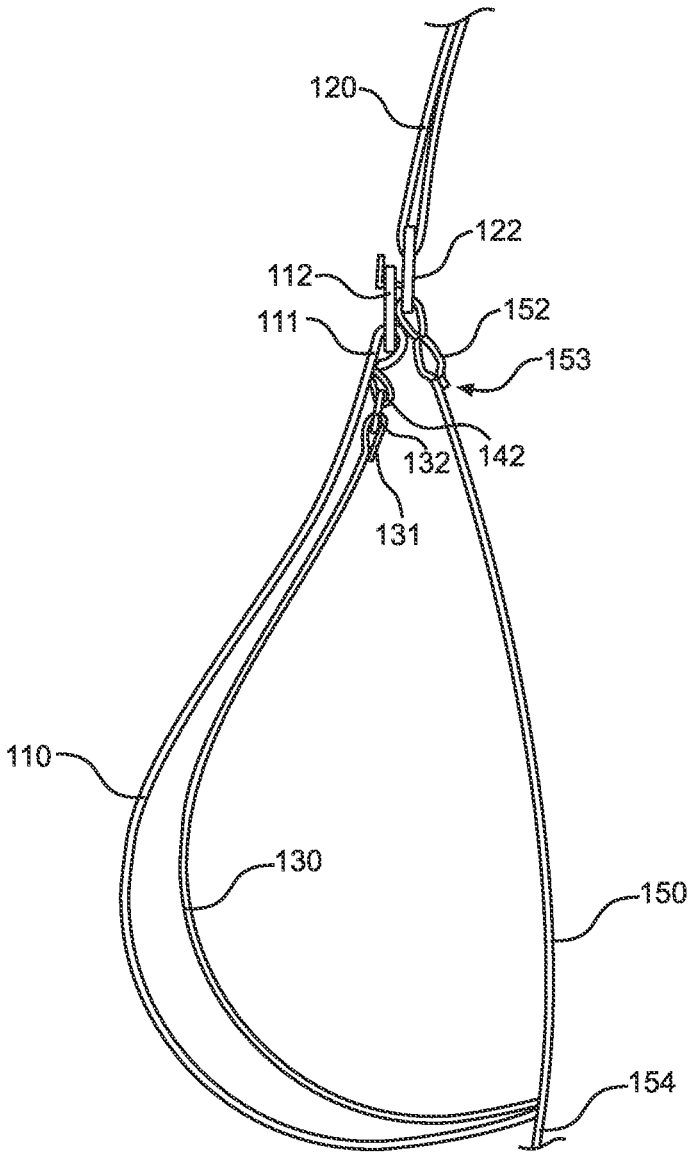
FIG. 3 is a partial cross-sectional side view of the multi-layer nursing garment in accordance with the first mode embodiment of the present invention, showing an inner cup coupled to an outer cup and the outer cup in turn coupled to a shoulder strap.

FIG. 3 illustrates that nursing garment 100 further includes a pair of inner breast cups 130 (one inner breast cup 130 per outer breast cup 110). Inner breast cups 130 are configured to cover the breasts of a wearer and outer breast cups 110 are configured to cover inner breast cups 130. Inner and outer breast cups 130, 110 can be made of the same material or different garment fabric materials without limiting the scope of the invention. Top portions 131 of inner breast cups 130 are attached to third connectors 132. At least one of inner breast cups 130 includes an opening 133 (see FIG. 6) to permit breastfeeding or pumping milk from the breast. Outer breast cups 110 are further shown to include fourth connectors 142 attached to an interior side thereof, near top portions 111. Nursing garment 100 further includes, as shown at least in FIGS. 2 and 3, support straps 150 attached to fifth connectors 152 (support strap connectors 152) at first ends 153 thereof. Support straps 150 are connected, via fifth connectors 152, to second connectors 122 (and therefore to shoulder straps 120) and are attached at second ends 154 to body support 102.

Nursing garment 100 functions in a variety of modes to provide nursing support (e.g., selective breastfeeding or breast pumping) without removing garment 100. In particular, each of outer breast cups 110 may be selectively opened and closed via coupling or decoupling of first connectors 112 and second connectors 122, while each of inner breast cups 130 may be selectively opened and closed via coupling or decoupling of third connectors 132 with either fourth connectors 142 (attached to outer breast cups 110) or fifth connectors 152 (provided along support straps 150). A wearer may wear nursing garment 100 throughout the day and may maneuver the inner and/or outer breast cups 110, 130, as needed, depending on whether it is necessary to breastfeed or pump breast milk as described further below. By removing the need to frequently change clothes, the wearer benefits both in terms of convenience and saving time, as well as avoiding the need to subject nursing garments to excessive washing, thereby minimizing inherent wear and tear that accompanies washing.

FIGS. 1-3 show nursing garment 100 in a first mode in which first connectors 112 are coupled to second connectors 122 such that outer breast cups 110 cover inner breast cups 130. In this first mode, the user does not have immediate access to inner breast cups 130 or the wearer's breasts beneath inner breast cups 130. This first mode is one embodiment of how nursing garment 100 may be worn during times when breastfeeding or breast pumping is not needed. Also in this first mode, third connectors 132 of inner breast cups 130 are coupled with fourth connectors 142 of outer breast cups 110 so as to facilitate breastfeeding via the simultaneous opening/lowering of an outer breast cup 110 and an inner breast cup 130 together (e.g., a second mode as shown in FIG. 4 and described further below).

Figure 4:
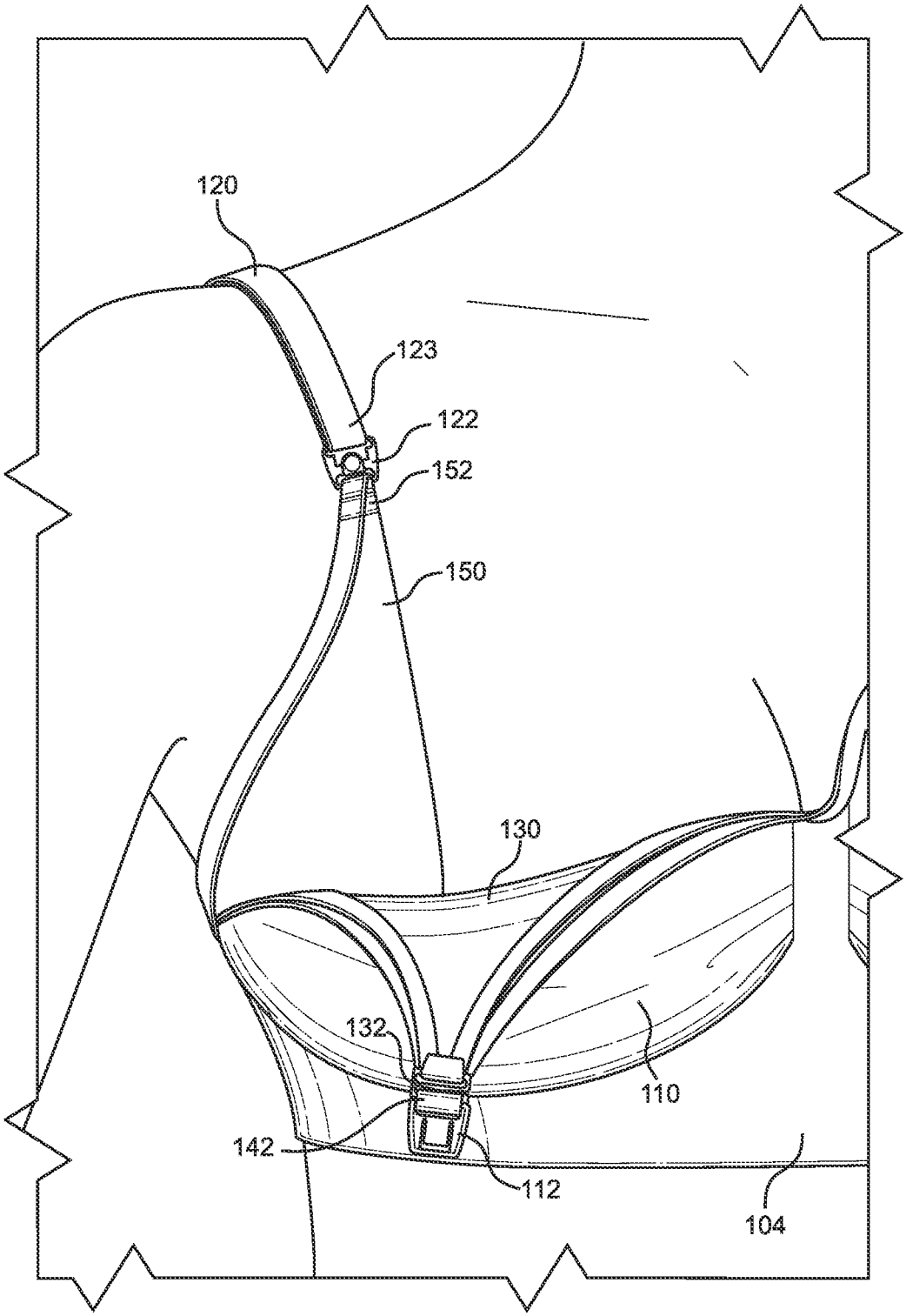
FIG. 4 is a perspective view of a multi-layer nursing garment in accordance with a second mode embodiment of the present invention showing an inner cup coupled to an outer cup and the inner and outer cup together decoupled and opened/lowered from a shoulder strap to facilitate breastfeeding.

FIG. 4 shows nursing garment 100 in a second mode in which a wearer's breast is accessed, such as for breastfeeding. As discussed above, inner breast cup 130 is coupled to a respective outer breast cup 110 via the coupling of third and fourth connectors 132 and 142, respectively. First connector 112 of outer breast cup 110 is decoupled from second connector 122 and together the inner breast cup 130 and outer breast cup 110 are simultaneously lowered to reveal a wearer's breast. Shoulder strap 120 remains in place due to its attachment to support strap 150. A wearer who is primarily breastfeeding or otherwise needing access to the entire breast would likely operate nursing garment 100 in the first and second modes shown in FIGS. 1-4.

Figure 5:
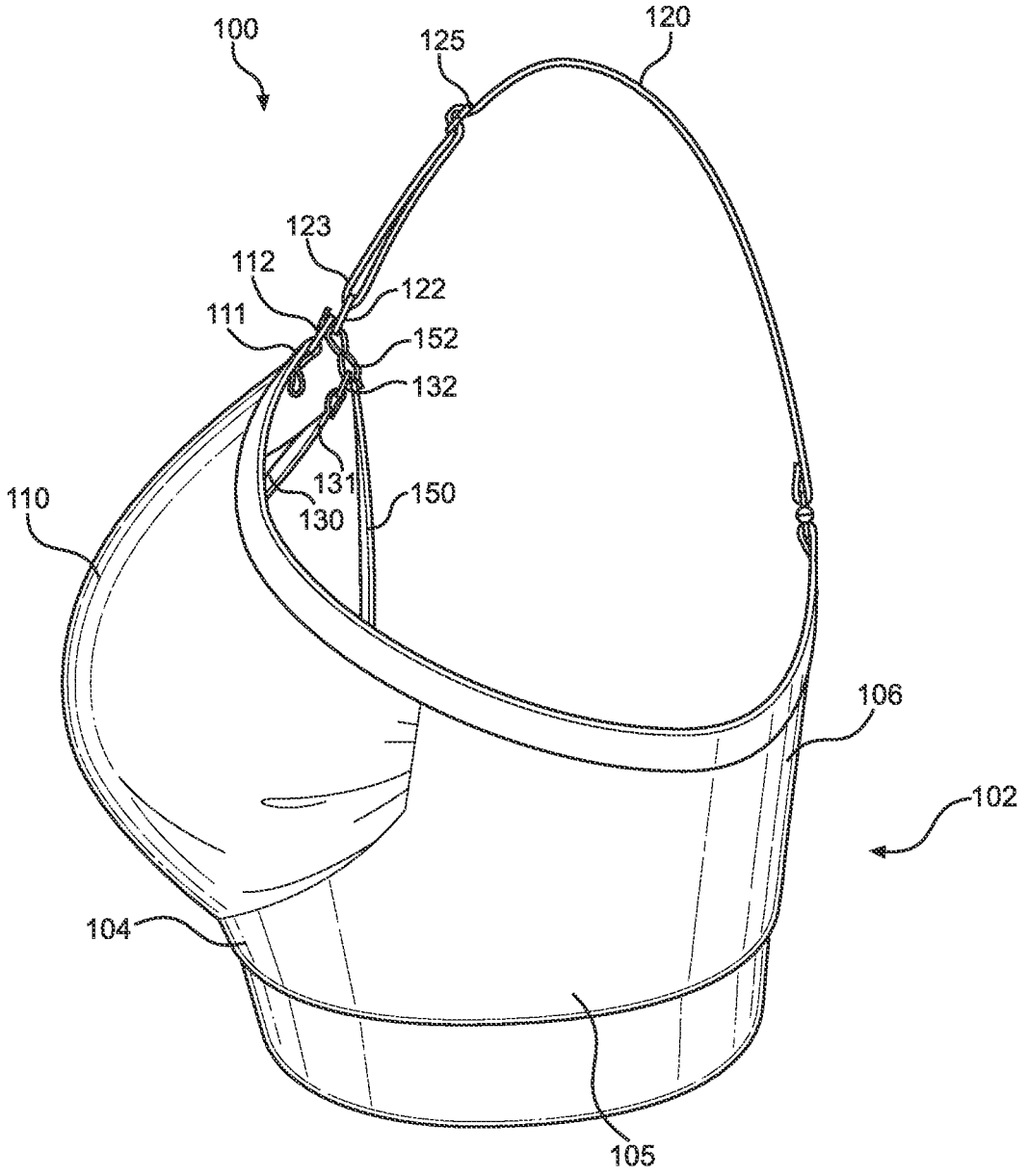
FIG. 5 is side view of a multi-layer nursing garment in accordance with a third mode embodiment of the present invention showing an inner cup coupled to a support strap and an outer cup panel coupled to a shoulder strap.

FIG. 5 shows nursing garment 100 in a third mode, which is an alternative to the first mode of FIGS. 1-3, wherein, instead of inner cups 130 being connected to outer cups 110 via coupling of third connectors 132 and fourth connectors 142 (first mode), inner cups 130 are attached to support straps 150 via coupling of third connectors 132 and fifth connectors 152. As with the first mode, in the third mode, the user does not have immediate access to inner breast cups 130 or the wearer's breasts beneath inner breast cups 130. This third mode is another embodiment showing how nursing garment 100 may be worn during times when breastfeeding or breast pumping is not needed. Unlike in the first mode, in the third mode, third connectors 132 of inner breast cups 130 are not coupled with fourth connectors 142 of outer breast cups 110. As such, opening/lowering of an outer breast cup 110 is achieved independently of an inner breast cup 130 and vice versa. This third mode may be beneficial when the wearer is primarily pumping as discussed more fully below with reference to a fourth mode as shown in FIGS. 6 and 7.

Figure 6:
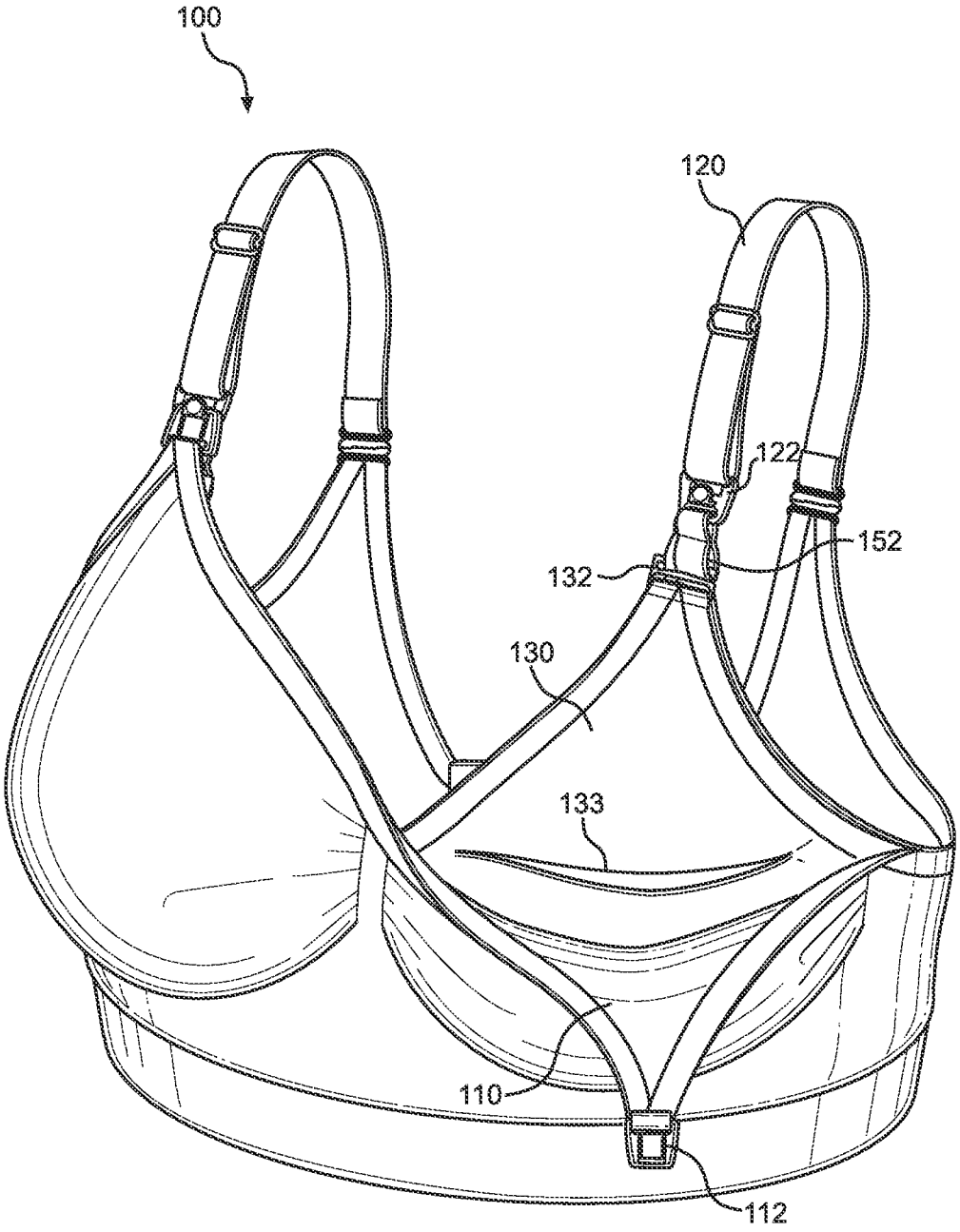
FIG. 6 is a perspective view of a multi-layer nursing garment in accordance with a fourth mode embodiment of the present invention showing an inner cup having an opening therein and being coupled to a support strap, and an outer cup decoupled from a shoulder strap to facilitate access to the inner cup and its opening (e.g., for hand-free breast pumping).
Figure 7:
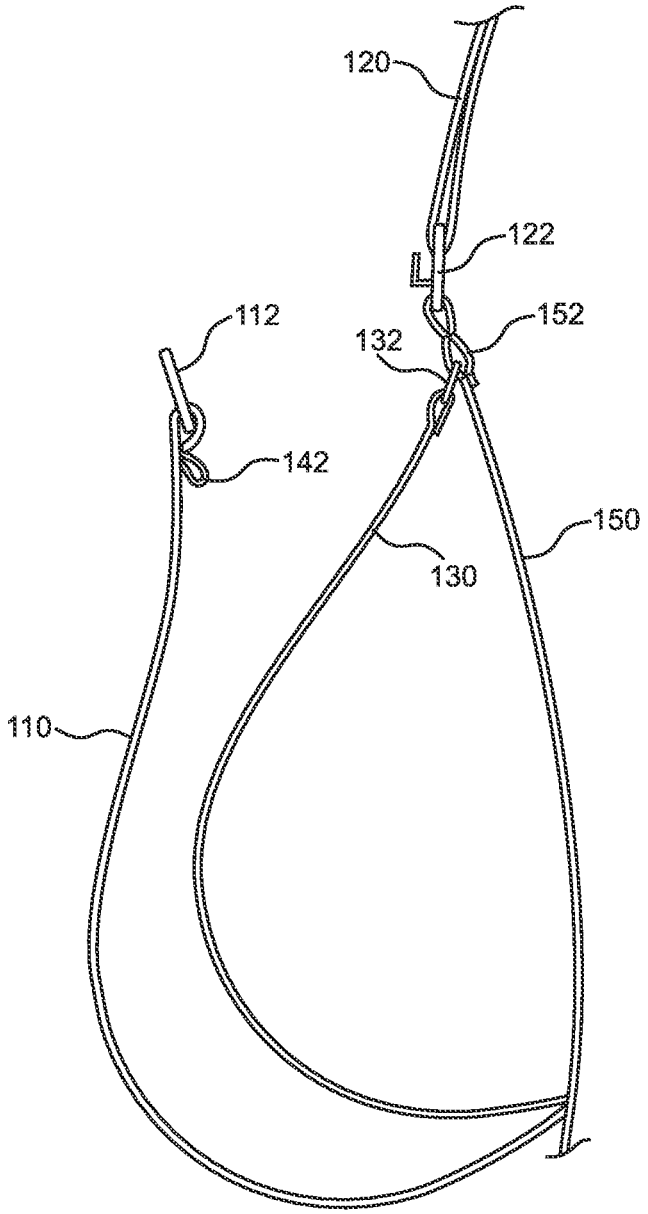
FIG. 7 is a partial cross-sectional side view of the multi-layer nursing garment in accordance with the fourth mode embodiment of the present invention showing the inner cup coupled to a support strap and the outer cup decoupled from the shoulder strap to facilitate access to the inner cup.
Figure 8:
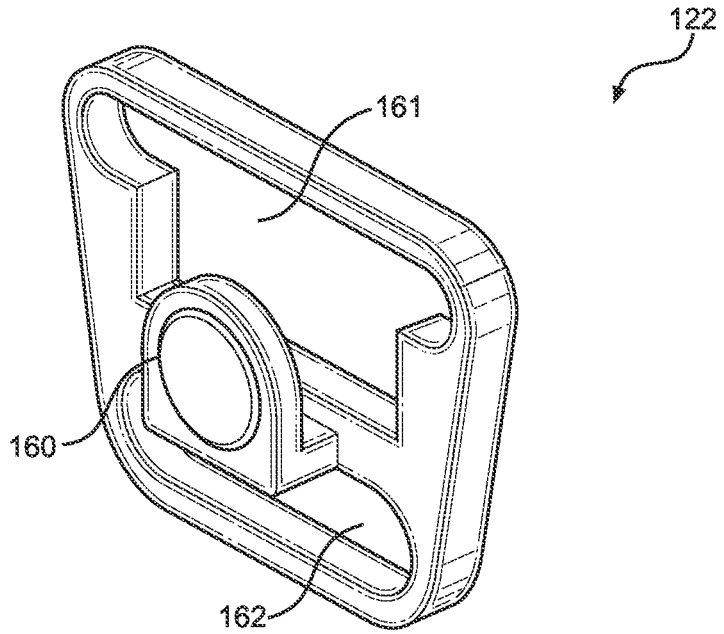
FIG. 8 is a perspective view of a connector of the multi-layered nursing garment in accordance with an embodiment of the present invention.
Figure 9:
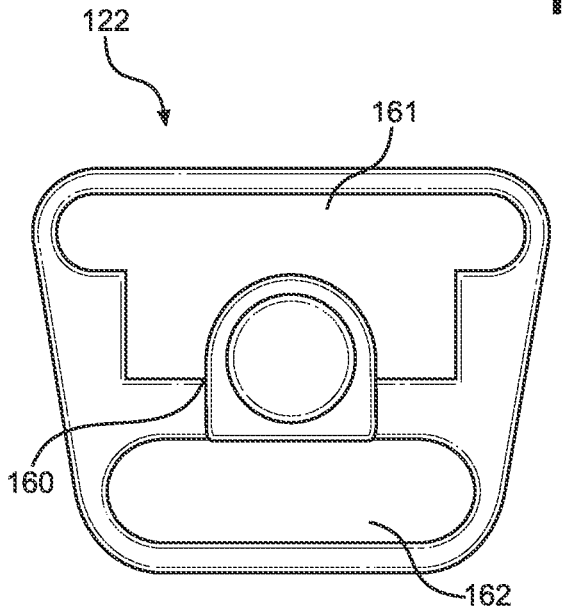
FIG. 9 is a front view of the connector of FIG. 8.
Figure 10:
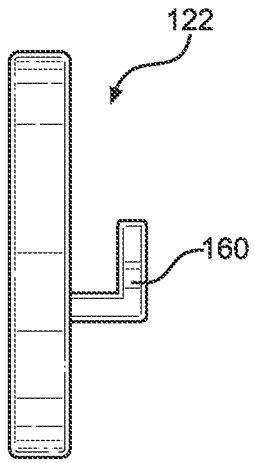
FIG. 10 is a side view of the connector of FIG. 8.

FIGS. 6 and 7 show nursing garment 100 in a fourth mode in which an inner cup 130 is accessed, such as for hands-free breast pumping. In this configuration, at least one of inner breast cups 130 is coupled to a respective support strap 150 via coupling of third and fifth connectors 132 and 152, respectively (i.e., as in the third mode described above). As shown, first connector 112 of outer breast cup 110 is decoupled from second connector 122 and outer breast cup 110 is opened/lowered to reveal inner cup 130 and its opening 133. Opening 133 provides access to the wearer's breast for e.g., hands-free breast pumping. For example, a breast shield or flange of a breast pump (not shown) is inserted into opening 133 to dispose the shield or flange in contact with the breast. Preferably, inner breast cup 130 and opening 133 together support/secure the breast pump such that the wearer does not manually hold the pump and the wearer is free to use their hands for other tasks during pumping (e.g., the materials used for inner breast cup 130 have elasticity and/or the opening 133 is disposed at an oblique angle). Although opening 133 is shown as a horizontal cut-out opening in inner breast cup 130, one or ordinary skill in the art would recognize that different designs/orientations may be employed (e.g., a vertical slit, a diagonal stitched seam having a section of overlapping fabric that parts to reveal an opening, or the like). In any case, it should be clear that wearer who is primarily breast pumping or otherwise just needs access to inner cup 130 would likely operate nursing garment 100 in the third and fourth modes shown in FIGS. 5-7.

Although not shown, other modes are encompassed by the features of present invention as would be recognized by one of ordinary skill in the art. In particular, one of ordinary skill in the art would recognize the ability to use one or more of the connectors to sequentially open different layers of the nursing garment, and to allow the nursing mother to select from breastfeeding and milk pumping as an option for either breast, and she can do so simultaneously with one breast being used for breastfeeding and the other for milk pumping if such is desirable. For example, as a hybrid of the first and third modes, one of inner cups 130 may be attached to its respective support strap 150 while the other of inner cups 130 may be attached to its respective outer cup 110 such that one of the wearer's breasts is primarily accessed for breastfeeding (the inner and outer cup are simultaneously opened/lowered together) while the other one of the wearer's breasts is primarily accessed for breast pumping (via the inner cup; just the outer cup is opened/lowered).

Figure 11:
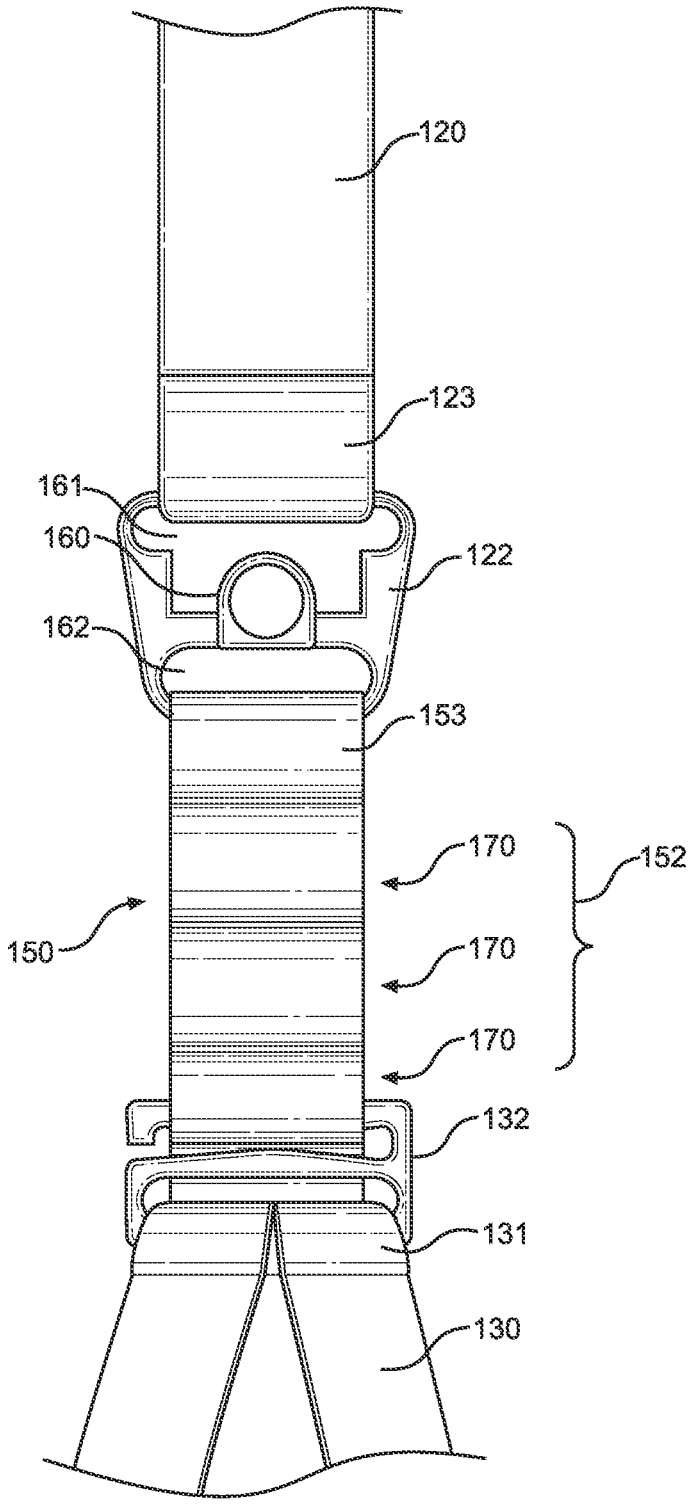
FIG. 11 is an enhanced front view of connecters of a multi-layered nursing garment in accordance with an embodiment of the present invention coupled to at least one of a shoulder strap, a support strap and an inner cup of the nursing garment.
Figure 12:
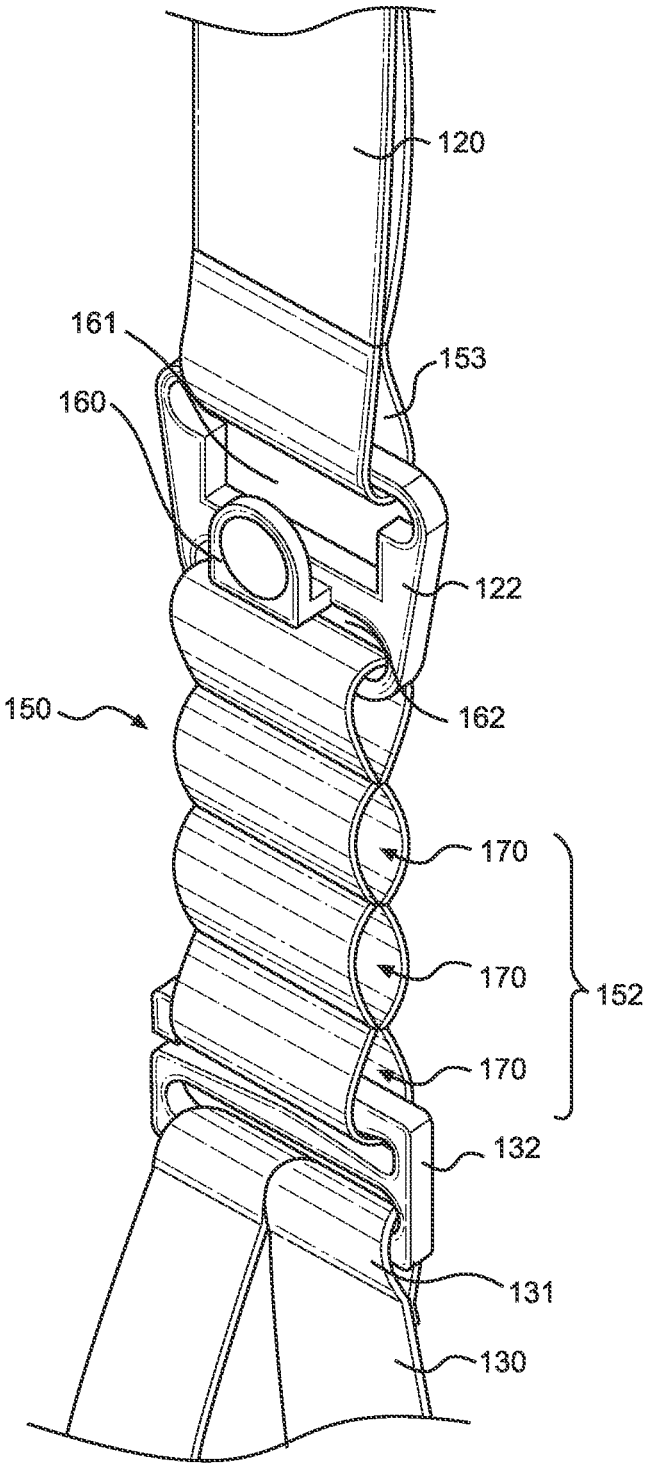
FIG. 12 is a side perspective view of the arrangement of FIG. 11.

FIGS. 8-12 show embodiments of various connectors in detail. As shown, a second connector 122 features a hook 160 and well as an upper opening 161 and a lower opening 162. Preferably, as depicted in previous figures, first connector 112 couples second connector 122 via hook 160. In particular, first connector 112 preferably includes an opening to receive hook 160 and a tab portion to engage hook 160. FIGS. 11 and 12 show how second connector 122 bridges shoulder strap 120 and support strap 150, with first end 123 of shoulder strap 120 fed through upper opening 161 and first end 153 of support strap 150 fed through lower opening 162. FIGS. 11 and 12 also show an embodiment of fifth connector 152. Unlike fifth connector 152 shown in the previous figures, fifth connector 152 shown in FIGS. 11 and 12 features multiple loops 170 to which third connector 132 (shown as a generally S-shaped hook, unlabeled) can couple. FIGS. 11 and 12 further show third connector 132 includes an opening (not labeled) opposite the hook portion through which top end 131 of inner bra cup 130 is fed. One of ordinary skill in the art would understand that the S-shaped hook of third connector 132 could be selectively positioned by the wearer in any one of loops 170 (and possibly even the portion of strap 150 fed through opening 162) to adjust the tension of inner cup 130 (attached to body portion 102 at its other end) as needed.

Although described with reference to preferred embodiments of the invention, it should be readily understood that various changes and/or modifications can be made to the invention without departing from the spirit thereof. For instance, particular designs for the various connectors (e.g., second connector 122, third connector 123) have been set forth above. However, as also referenced above, other designs for the connectors are possible without departing from the invention. In general, the invention is only intended to be limited by the scope of the following claims.

The invention claimed is:

1. A multi-layered nursing garment comprising:

an inner breast cup configured to cover a first breast of a wearer;

an outer breast cup configured to cover the inner breast cup;

a shoulder strap;

a first connector attached to the outer breast cup;

a second connector attached to the shoulder strap;

a third connector attached to the inner breast cup; and a fourth connector attached to the outer breast cup, wherein the first connector is configured to be coupled to the second connector in enabling selective attaching or detaching of the outer breast cup to the shoulder strap, and the third connector is configured to be coupled to the fourth connector in enabling the inner breast cup to be selectively connected or disconnected to the outer breast cup at the fourth connector.

2. The multi-layered nursing garment of claim 1, wherein the inner breast cup includes an opening configured to receive a portion of a breast pump.

3. The multi-layered nursing garment of claim 1, wherein the fourth connector is attached to an interior side of the outer breast cup such that the inner breast cup is selectively connected to the outer breast cup at an interior side of the outer breast cup.

4. The multi-layered nursing garment of claim 3, wherein the fourth connector includes a loop and the third connector includes a hook.

5. A multi-layered nursing garment comprising:

an inner breast cup configured to cover a first breast of a wearer;

an outer breast cup configured to cover the inner breast cup;

a shoulder strap;

a first connector attached to the outer breast cup;

a second connector attached to the shoulder strap;

a third connector attached to the inner breast cup;

a fourth connector attached to the outer breast cup, wherein the first connector is configured to be coupled to the second connector in enabling selective attaching or detaching of the outer breast cup to the shoulder strap, and the third connector is configured to be coupled to the fourth connector in enabling the inner breast cup to be selectively connected or disconnected to the outer breast cup at the fourth connector; and a support strap attached to a fifth connector, wherein the third connector is configured to be coupled to the fifth connector in enabling the inner breast cup to be selectively connected or disconnected to the support strap at the fifth connector.

6. The multi-layered nursing garment of claim 5, wherein the support strap is connected to the second connector via the fifth connector.

7. The multi-layered nursing garment of claim 5, wherein the fifth connector includes a first loop and the third connector includes a hook.

8. The multi-layered nursing garment of claim 7, wherein the fifth connector further includes a second loop and the hook is configured to selectively couple the fifth connector at the first loop or at the second loop.

9. A method of using a multi-layered nursing garment, the method comprising:

selectively opening or closing an outer breast cup of the nursing garment relative to a shoulder strap of the nursing garment via coupling or decoupling of a first connector attached to the outer breast cup to a second connector attached to the shoulder strap; and selectively connecting or disconnecting an inner breast cup of the nursing garment to the outer breast cup via coupling or decoupling of a third connector attached to the inner breast cup to a fourth connector attached to the outer breast cup wherein, when the third connector of the inner breast cup is coupled to the fourth connector of the outer breast cup, coupling the first connector of the outer breast cup to the second connector of the shoulder strap indirectly couples the inner breast cup to the shoulder strap.

10. The method of claim 9, wherein the fourth connector is attached to an interior side of the outer breast cup such that connecting the inner breast cup to the outer breast cup includes connecting the inner breast cup to the interior side of the outer breast cup.

11. The method of claim 9, wherein the fourth connector includes a loop and the third connector includes a hook such that connecting the inner breast cup to the outer breast cup includes coupling the hook and the loop.

12. The method of claim 9, further comprising selectively connecting or disconnecting the inner breast cup to a support strap of the nursing garment via coupling of the third connector to a fifth connector attached to the support strap.

13. The method of claim 12, wherein the fifth connector includes a loop, the third connector includes a hook, and connecting the inner breast cup to the support strap includes coupling the hook and the loop.

14. The method of claim 13, wherein the fifth connector includes a second loop and connecting the inner breast cup to the support strap includes coupling the hook at a select one of the first loop and the second loop.

* * * * *